US009145679B2

(12) United States Patent
Ahern

(10) Patent No.: US 9,145,679 B2
(45) Date of Patent: Sep. 29, 2015

(54) FORM ASSEMBLY FOR CONCRETE SLABS AND METHODS OF ASSEMBLING SAME

(75) Inventor: Don Francis Ahern, Las Vegas, NV (US)

(73) Assignee: XTREME MANUFACTURING, LLC, Las Vegas, NV (US)

( * ) Notice: Subject to any disclaimer, the term of this patent is extended or adjusted under 35 U.S.C. 154(b) by 108 days.

(21) Appl. No.: 13/523,125

(22) Filed: Jun. 14, 2012

(65) Prior Publication Data

US 2013/0333314 A1 Dec. 19, 2013

(51) Int. Cl.

| | |
|---|---|
| ***E04C 2/06*** | (2006.01) |
| ***E04C 2/38*** | (2006.01) |
| ***E04C 5/06*** | (2006.01) |
| ***E04B 5/04*** | (2006.01) |
| ***E04C 5/16*** | (2006.01) |
| ***E04C 2/28*** | (2006.01) |

(52) U.S. Cl.
CPC ... *E04C 2/06* (2013.01); *E04B 5/04* (2013.01); *E04C 2/28* (2013.01); *E04C 2/38* (2013.01); *E04C 2/384* (2013.01); *E04C 5/0627* (2013.01); *E04C 5/166* (2013.01)

(58) Field of Classification Search
CPC ..... E04G 9/00; E04G 9/05; E04G 9/06; E04G 11/00; E04G 11/36; E04G 13/00; E04G 17/001; E04G 17/02; E04G 17/04; E04G 17/06; E04G 17/14; E04G 21/02; E04G 21/04; E04G 21/42; E04G 21/841; E04G 21/85; E04G 21/25; E04C 2/38; E04C 2/384; E04C 2/388; E04C 2/50; E04C 2/523; E04C 2/044; E04C 2/06; E04C 2/26; E04C 5/08; E04C 5/68; E04C 5/66; E04C 5/06; E04C 5/0627; E04C 2002/04; E04C 2002/044; B66C 1/666; E04B 1/41; E04B 5/04
USPC ..... 52/125.2–125.6, 223.1, 223.6, 223.7, 52/648.1, 649.1, 649.6, 649.7, 649.8, 52/650.3, 651.11, 656.1, 657, 378, 379, 52/380, 383, 698, 699, 700, 701, 707, 414, 52/583, 630, 648, 742.1, 742.14, 745.06, 52/745.2; 249/1, 2, 13, 18, 21, 22, 28, 38, 249/43, 93, 94
See application file for complete search history.

(56) References Cited

U.S. PATENT DOCUMENTS

| | | | | | |
|---|---|---|---|---|---|
| 1,031,926 | A | * | 7/1912 | Hansbrough | 52/259 |
| 1,075,251 | A | * | 10/1913 | Graham | 52/252 |
| 1,075,252 | A | | 10/1913 | Graham | |

(Continued)

*Primary Examiner* — Joshua J Michener
*Assistant Examiner* — Theodore Adamos
(74) *Attorney, Agent, or Firm* — Duane Morris LLP; Manita Rawat

(57) ABSTRACT

A form assembly includes an outer frame having a predefined shape. The frame includes at least two segments that are coupled together at a coupling portion. Each segment includes a first flange and a second flange positioned a predefined distance from the first flange. The first flange includes openings that extend substantially therethrough and the second flange includes openings that extend substantially therethrough and that are substantially concentrically aligned with the first flange openings. A lifting apparatus is positioned in a location that is bounded by the frame. Rebar members are coupled to the frame such that at least a portion of one of the rebar members is positioned within one first and second flange openings. At least four rebar segments are coupled to the lifting apparatus such that the rebar segments define an X-shape within the form assembly to facilitate maintaining the frame in the predefined shape.

21 Claims, 5 Drawing Sheets

(56) References Cited

U.S. PATENT DOCUMENTS

| | | | | | |
|---|---|---|---|---|---|
| 3,173,226 | A | * | 3/1965 | Solnick | 52/89 |
| 3,195,277 | A | * | 7/1965 | Greulich | 52/223.6 |
| 3,355,897 | A | * | 12/1967 | Mullen, Jr. | 405/268 |
| 3,475,529 | A | * | 10/1969 | Lacy | 264/228 |
| 3,495,800 | A | * | 2/1970 | Fisher | 249/20 |
| 3,609,935 | A | * | 10/1971 | Thomas | 52/745.11 |
| 3,621,624 | A | * | 11/1971 | Gustafson | 52/91.1 |
| 3,757,482 | A | * | 9/1973 | Haeussler | 52/405.3 |
| 3,760,540 | A | * | 9/1973 | Latoria et al. | 52/125.5 |
| 3,774,359 | A | * | 11/1973 | Kahn | 52/125.4 |
| 3,785,606 | A | * | 1/1974 | Green | 249/3 |
| 4,059,939 | A | * | 11/1977 | Elliott | 52/745.11 |
| 4,076,777 | A | | 2/1978 | Petrovitch | |
| 4,121,804 | A | * | 10/1978 | O'Leary | 249/187.1 |
| 4,141,532 | A | * | 2/1979 | Wall | 249/94 |
| 4,451,022 | A | * | 5/1984 | Sauger | 249/2 |
| 4,706,430 | A | | 11/1987 | Sugita et al. | |
| 5,242,249 | A | * | 9/1993 | Grayson | 405/286 |
| 5,431,510 | A | | 7/1995 | Reinert, Sr. | |
| 5,635,097 | A | * | 6/1997 | Aiello | 249/38 |
| 5,881,527 | A | | 3/1999 | Haseotes | |
| 6,494,008 | B1 | * | 12/2002 | Bloem et al. | 52/405.1 |
| 6,874,288 | B1 | * | 4/2005 | Washa et al. | 52/371 |
| 2004/0010984 | A1 | * | 1/2004 | Wright | 52/125.4 |
| 2005/0072115 | A1 | | 4/2005 | Chappell et al. | |
| 2005/0144866 | A1 | | 7/2005 | Chappell et al. | |
| 2007/0039277 | A1 | | 2/2007 | Mossbeck | |
| 2007/0157541 | A1 | * | 7/2007 | Mossbeck et al. | 52/677 |
| 2008/0022610 | A1 | | 1/2008 | Gjelsvik et al. | |
| 2009/0116906 | A1 | * | 5/2009 | Kaylor et al. | 404/75 |
| 2009/0178356 | A1 | | 7/2009 | Baumann | |
| 2009/0217612 | A1 | * | 9/2009 | Window | 52/414 |
| 2011/0005695 | A1 | | 1/2011 | Boone et al. | |

* cited by examiner

FORM ASSEMBLY FOR CONCRETE SLABS AND METHODS OF ASSEMBLING SAME

BACKGROUND OF THE INVENTION

The field of the invention relates generally to concrete slabs and, more particularly, to form assemblies that may be used to fabricate concrete slabs.

At least some known concrete slabs may be formed or molded within a form assembly. Known form assemblies include a plurality of segments, such as wood pieces, that are coupled together to form an outer frame having a desired shape, such as a substantially square shape. The segments are coupled to the ground via at least one post member, such as a stake. Reinforcement bars (i.e., rebar members) are positioned within the outer frame and at least one support member is positioned directly beneath one of the rebar members to maintain the rebar members a predefined distance above the ground. When the form assembly is assembled and coupled to the ground, wet composite construction material, such as concrete, may be poured into the form assembly. After the concrete dries, a concrete slab is formed and the wood segments may be removed.

Such form assemblies may expedite the formation of concrete slabs that may be used in, for example, construction sites, driveways, yards, and buildings. However, depending on the desired size of the concrete slab, the wood segments may need to be measured and cut each use, prior to the segments being coupled together. Such a process can be labor intensive. Moreover, during the formation of the concrete slab, the wood segments may wear to a degree where they can no longer be used for subsequent slab frames. As such, the wood segments are merely discarded after use. Further, the rebar members are not attached to the wood segments and may move independently within the form assembly until the concrete slab is formed. Such form assemblies also require several posts or stakes to ensure that the wood segments will stay in place and will not move from the desired location on the ground. Accordingly, using such form assemblies to form concrete slabs may not be efficient and/or cost effective.

BRIEF DESCRIPTION OF THE INVENTION

In one embodiment, a form assembly is provided. The form assembly includes an outer frame that has a predefined shape. The outer frame includes at least two segments that are coupled together at a coupling portion. Each of the segments includes a first flange and a second flange positioned a predefined distance from the first flange. The first flange includes a plurality of first flange openings that extend substantially therethrough and the second flange includes a plurality of second flange openings that extend substantially therethrough. The second flange openings are substantially concentrically aligned with the first flange openings. A lifting apparatus is positioned in a location that is bounded by the outer frame. A plurality of rebar members are coupled to the outer frame such that at least a portion of one of the rebar members is positioned within one first flange opening and one second flange opening. At least four rebar segments are coupled to the lifting apparatus such that the four rebar segments define an X-shape within the form assembly to facilitate maintaining the outer frame in the predefined shape.

In another embodiment, a concrete slab is provided. The concrete slab includes a form assembly and a concrete composite construction material substantially evenly distributed within the form assembly. The form assembly includes an outer frame that has a predefined shape. The outer frame includes at least two segments that are coupled together at a coupling portion. Each of the segments includes a first flange and a second flange positioned a predefined distance from the first flange. The first flange includes a plurality of first flange openings that extend substantially therethrough and the second flange includes a plurality of second flange openings that extend substantially therethrough. The second flange openings are substantially concentrically aligned with the first flange openings. A lifting apparatus is positioned in a location that is bounded by the outer frame. A plurality of rebar members are coupled to the outer frame such that at least a portion of one of the rebar members is positioned within one first flange opening and one second flange opening. At least four rebar segments are coupled to the lifting apparatus such that the four rebar segments define an X-shape within the form assembly to facilitate maintaining the outer frame in the predefined shape.

In yet another embodiment, a method of assembling a form assembly is provided. An outer frame having a predefined shape is formed by coupling at least two segments at a coupling portion. Each of the segments includes a first flange and a second flange positioned a predefined distance from the first flange. The first flange includes a plurality of first flange openings extending substantially therethrough and the second flange includes a plurality of second flange openings extending substantially therethrough, wherein the second flange openings are substantially concentrically aligned with the first flange openings. A lifting apparatus is positioned in a location that is bounded by the outer frame. A plurality of rebar members are coupled to the outer frame such that at least a portion of one of the rebar members is positioned within one first flange opening and one second flange opening. At least four rebar segments are coupled to the lifting apparatus and to the outer frame such that the four rebar segments define an X-shape within the form assembly to facilitate maintaining the outer frame in the predefined shape.

DETAILED DESCRIPTION OF THE INVENTION

The exemplary apparatus, systems, and methods described herein overcome at least some known disadvantages associated with at least some known form assemblies that are used to form concrete slabs. More specifically, the embodiments described herein provide a form assembly that can be readily assembled to facilitate the fabrication of portable concrete slabs. The form assembly includes an outer frame having a predefined shape, wherein the outer frame includes four segments that are coupled to together at four different coupling portions. A lifting apparatus is positioned in a location that is bounded by the outer frame and a plurality of rebar members are coupled to the outer frame. At least four rebar segments are positioned on the rebar members. Moreover, the rebar segments are coupled to the lifting apparatus and to the outer frame such that the four rebar segments define an X-shape within the form assembly to facilitate maintaining the outer frame in the predefined shape. By using an outer frame with a predefined shape, no measuring equipment is necessary to measure the segments that make up the outer frame and no cutting is required. Moreover, the rebar members are securely coupled to the outer frame and will not move as concrete composite construction material is poured within the form assembly. Further, having the four rebar segments define a substantially X-shape within the form assembly to facilitate maintaining the outer frame in the predefined shape ensures the desired shape of the concrete slab. In addition, the lifting apparatus enables the concrete slab to be easily transported to any desired location. Such easy assembly enables a user to assemble multiple form assemblies to fabricate multiple concrete slabs that have a consistency in their finished product. Accordingly, the form assembly provides an efficient and/or cost effective solution for use in fabricating portable concrete slabs.

Figure 1:
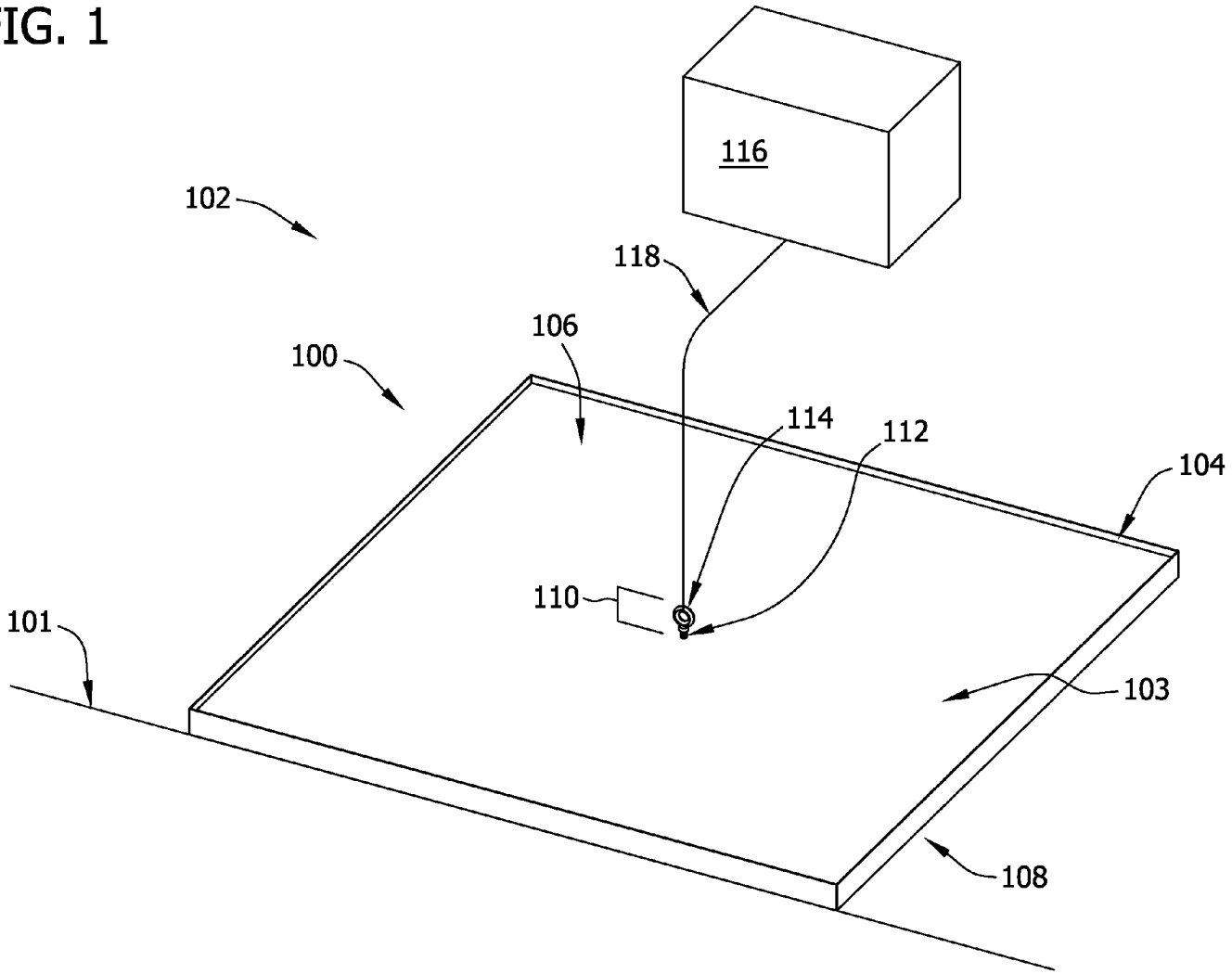
FIG. 1 is a block diagram of an exemplary concrete slab.

FIG. 1 illustrates an exemplary concrete slab 100 positioned on the ground 101 of a construction site 102. Slab 100 may also be used in a building or any other location where a user would want to position or use concrete slab 100. In the exemplary embodiment, concrete slab 100 is fabricated from a composite construction material 103 that is substantially evenly distributed within a form assembly 104. More specifically, in the exemplary embodiment, material 103 is concrete material that is composed primarily of aggregate, cement, and water. Alternatively, any other suitable type of construction material 103 may be used to fabricate concrete slab 100.

Concrete slab 100, in the exemplary embodiment, includes a first surface 106 and a second surface 108. At least a portion of a lifting apparatus 110 extends through first surface 106. More specifically, in the exemplary embodiment, lifting apparatus 110 includes a coupling portion or fastener 112 and a lifting eye 114 that extends from fastener 112, wherein at least a portion of fastener 112 and lifting eye 114 extend through first surface 106. Second surface 108 is positioned on ground 101.

In the exemplary embodiment, lifting apparatus 110 may be coupled to a lifting machine 116, such as a crane. More specifically, a cable 118 may be coupled to lifting eye 114 and extend from the lifting eye 114 to lifting machine 116. In the exemplary embodiment, lifting machine 116 can lift concrete slab 100 from ground 101 and move concrete slab 100 to a different desired location, including locations remote from construction site 102.

During formation of concrete slab 100, form assembly 104 is assembled and positioned on ground 101, as explained in more detail below. Concrete composite construction material 103 is then poured into the center area (not shown in FIG. 1) of form assembly 104 to prevent form assembly 104 from shifting or moving relative to the ground 101. Additional concrete composite construction material 103 is then poured within form assembly 104 such that the material 103 is substantially evenly distributed within form assembly 104. To ensure first surface 106 is substantially smooth, material 103 may be leveled or smoothed as soon as material 103 is poured into form assembly 104. Material 103 may be leveled or smoothed within form assembly 104 using any method known in the art. After concrete slab 100 has dried, slab 100 may remain on ground 101 for its intended use or concrete slab 100 may be moved to a different desired location by lifting machine 116.

Figure 2:
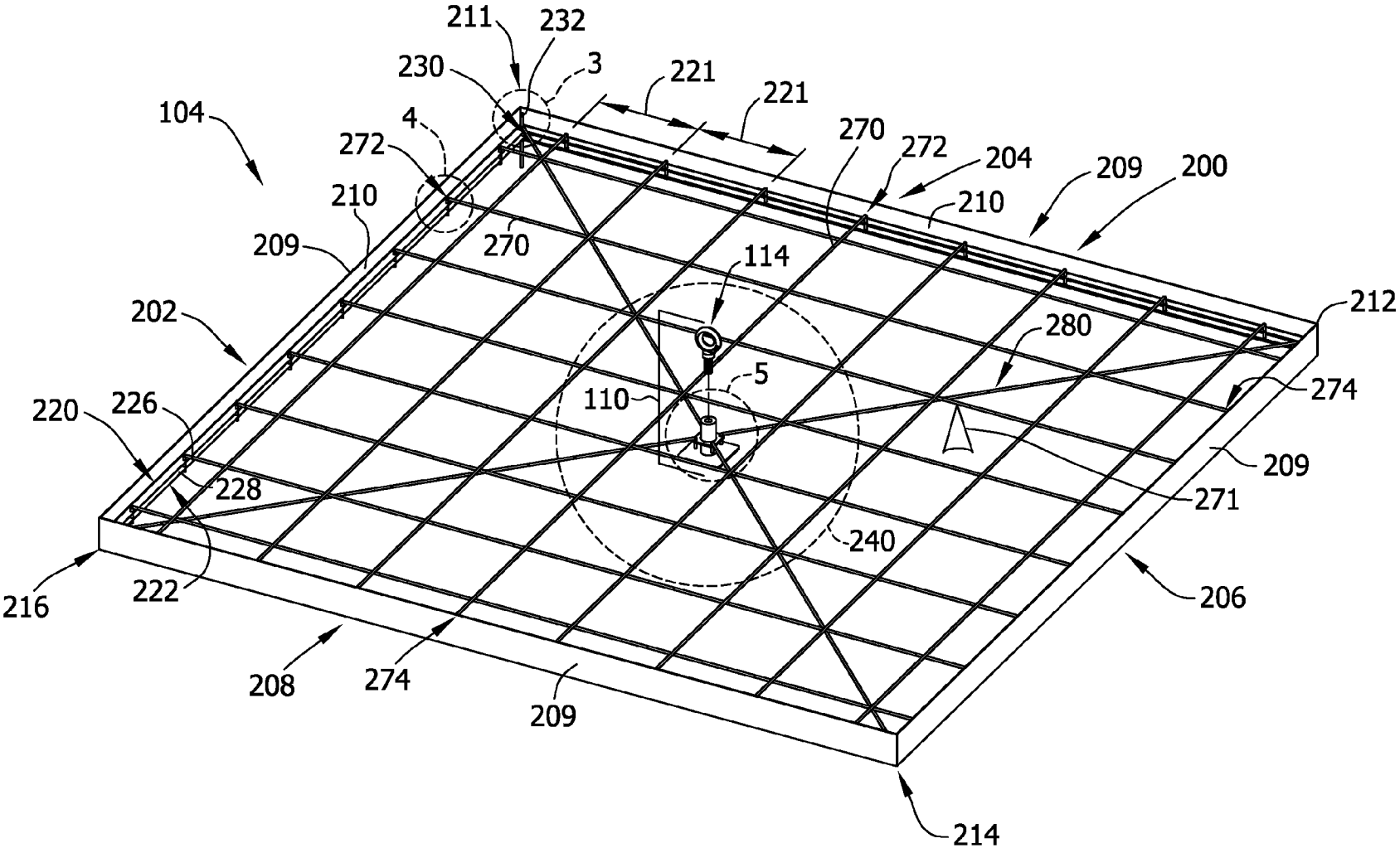
FIG. 2 is a perspective view of an exemplary form assembly that may be used with the concrete slab shown in FIG. 1.
Figure 3:
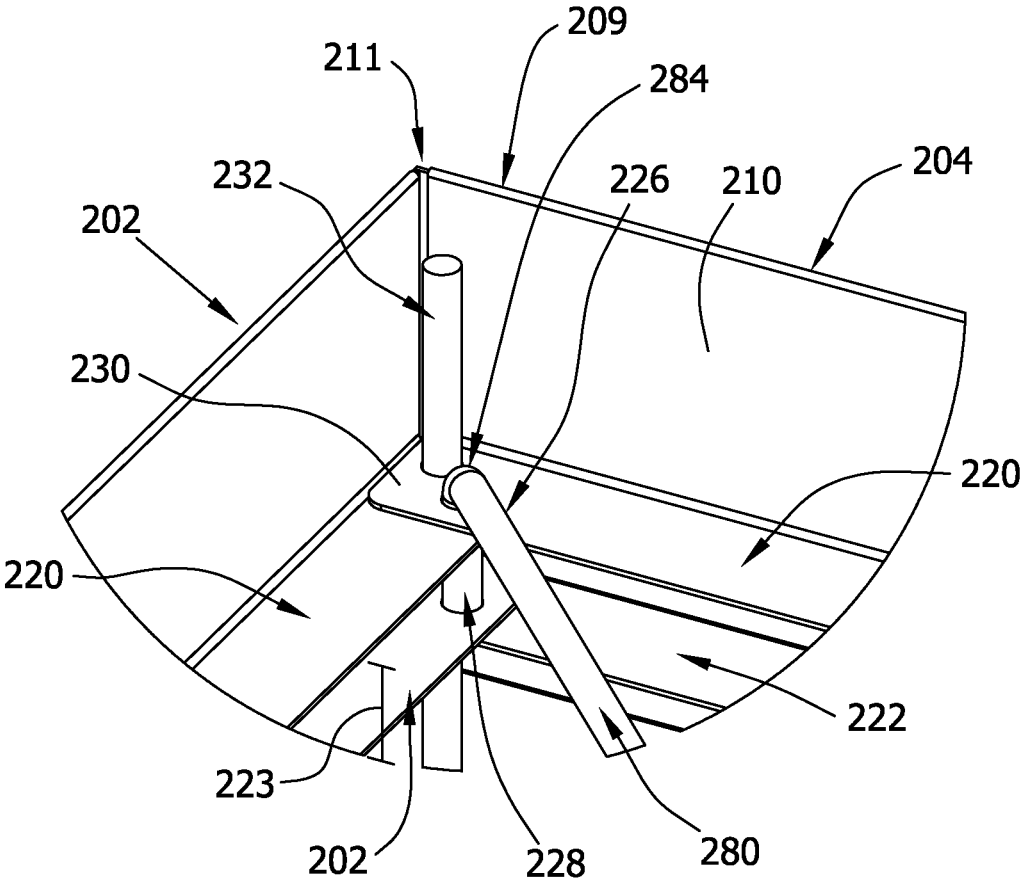
FIG. 3 is a perspective view of a portion of the form assembly shown in FIG. 2 and taken from area 3.
Figure 4:
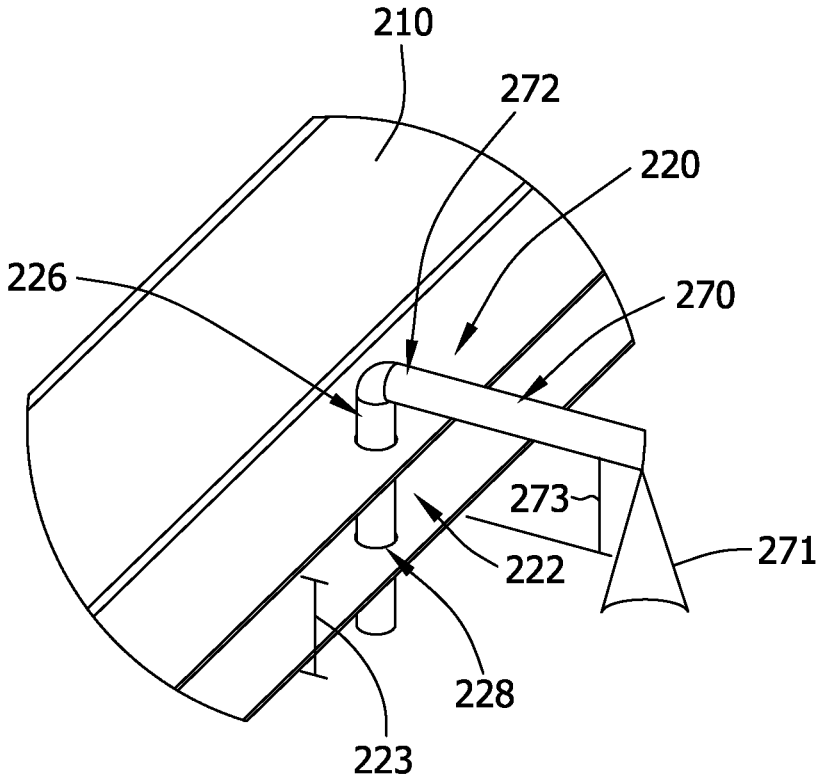
FIG. 4 is a perspective view of a portion of the form assembly shown in FIG. 2 and taken from area 4.
Figure 5:
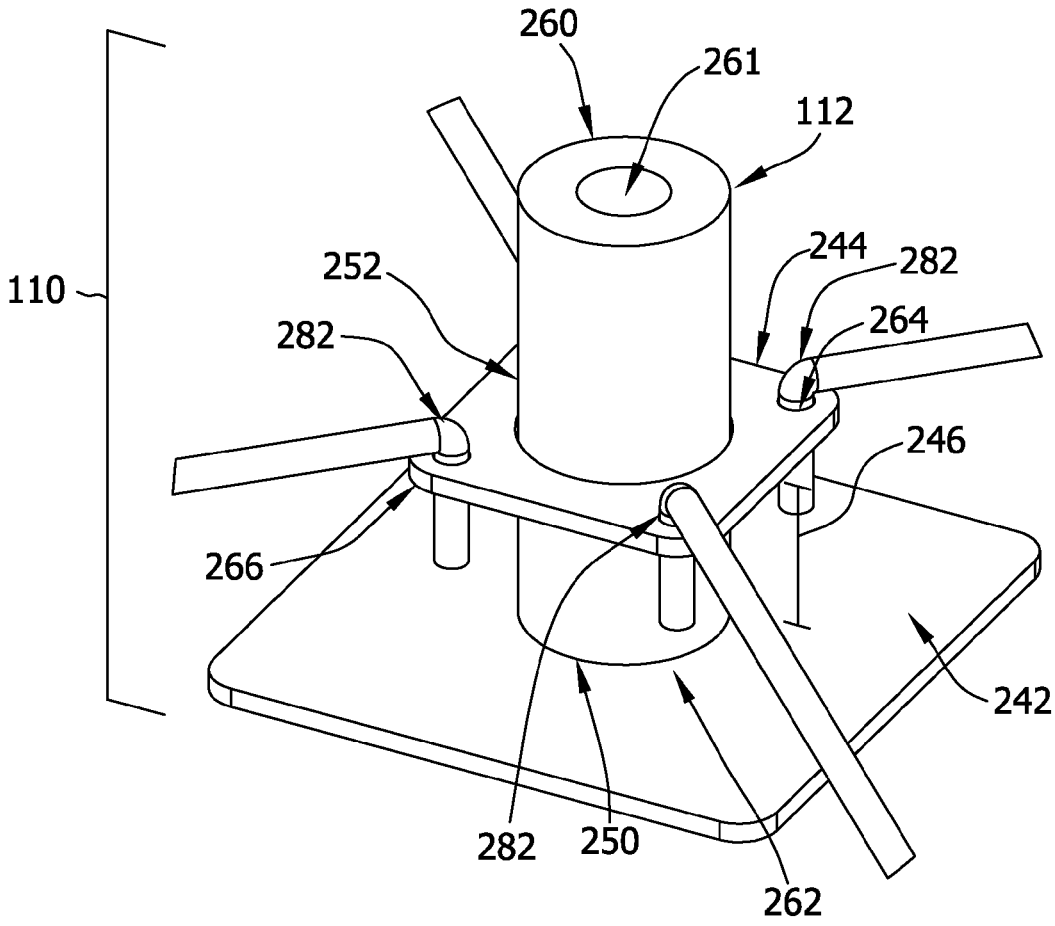
FIG. 5 is a perspective view of a portion of the form assembly shown in FIG. 2 and taken from area 5.

FIG. 2 illustrates a perspective view of form assembly 104. FIG. 3 is a perspective view of a portion of form assembly 104 taken from area 3 (shown in FIG. 2). FIG. 4 is a perspective view of a portion of form assembly 104 taken from area 4 (shown in FIG. 2). FIG. 5 is a perspective view of a portion of form assembly 104 taken from area 5 (shown in FIG. 2). In the exemplary embodiment, form assembly 104, includes an outer frame 200 that has a predefined shape. In the exemplary embodiment, outer frame 200 has a substantially square shape. Alternatively, outer frame 200 may have any other suitable shape that enables form assembly 104 to function as described herein.

In the exemplary embodiment, outer frame 200 includes a first segment 202, a second segment 204, a third segment 206, and a fourth segment 208. Each segment 202, 204, 206, and 208 has an exterior surface 209 and an opposite interior surface 210. In the exemplary embodiment, the shape of first segment 202, second segment 204, third segment 206, and fourth segment 208 are substantially similar and the dimensions of each segment 202, 204, 206, and 208 are approximately the same. Alternatively, segments 202, 204, 206, and 208 may have any other shape and may have varying dimensions. Further, in the exemplary embodiment, each segment 202, 204, 206, and 208 is substantially planar. More specifically, each exterior surface 209 and each interior surface 210 are substantially planar. Alternatively, segments 202, 204, 206, and 208 may be substantially arcuate.

In the exemplary embodiment, first segment 202 is coupled to second segment 204 at a first corner or first coupling portion 211. Similarly, second segment 204 is coupled to third segment 206 at a second corner or second coupling portion 212. Moreover, third segment 206 is coupled to fourth segment 208 at a third corner or third coupling portion 214. Moreover, fourth segment 208 is coupled to first segment 202 at a fourth corner or fourth coupling portion 216. In the exemplary embodiment, segments 202, 204, 206, and 208 may each be fabricated from a metal, such as steel, plastics, and/or composites. Alternatively, segments 202, 204, 206, and/or 208 may be fabricated from other suitable types of material that enables form assembly 104 to function as described herein.

First, second, third, and fourth segments, 202, 204, 206, and 208, respectively, each include a first flange 220 and a second flange 222 that is positioned a predefined distance 223 from first flange 220. More specifically, first flange 220 and second flange 222 extend substantially outwardly from interior surface 210 and are each substantially perpendicular to interior surface 210. First flange 220 includes a plurality of first flange openings 226 that extend substantially through first flange 220 and are spaced a predefined distance 221 from each other. Similarly, second flange 222 includes a plurality of second flange openings 228 that extend substantially through second flange 222, wherein second flange openings 228 are spaced distance 221 from each other and are substantially concentrically aligned with first flange openings 226. Moreover, in the exemplary embodiment, first flange opening 226 and second flange openings 228 are spaced such that each coupling portion 211, 212, 214, and 216 includes one first flange opening 226 and one second flange opening 228. At each coupling portion 211, 212, 214, and 216, in addition to first flange and second flange openings 228 and 226, respectively, each first flange 220 also includes a second opening 230 and each second flange 222 includes a second opening (not shown) that is substantially concentrically aligned with second opening 230.

Form assembly 104 includes at least four posts 232 arranged such that one post 232 is coupled to each coupling portion 211, 212, 214, and 216. More specifically, in the exemplary embodiment, one post 232 is positioned within opening 230 and within the opening on second flange 230 that is concentrically aligned with opening 230. Each post 232 extends a distance (not shown) into the ground 101 (shown in FIG. 1) to secure form assembly 104 in position and to prevent form assembly 104 from shifting or moving as construction material 103 is poured into form assembly 104. In the exemplary embodiment, posts 232 are metal stakes. Alternatively, posts 232 may be any other suitable coupling device that facilitates anchoring form assembly 104 relative to the ground 101.

In the exemplary embodiment, lifting apparatus 110 is positioned in a location that is bounded by outer frame 200. More specifically, in the exemplary embodiment, lifting apparatus 110 is positioned within a center area 240 of form assembly 104. Alternatively, lifting apparatus 110 may be positioned in any area within form assembly 104 that enables lifting apparatus 110 to be used to move form assembly 104. In the exemplary embodiment, lifting apparatus 110 includes a first plate 242 configured to rest on ground 101 and a second plate 244 positioned a predefined distance 246 from first plate 242. First plate 242 includes a first plate opening 250 and second plate 244 includes a second plate opening 252 that is concentrically aligned with first plate opening 250. Coupling portion or fastener 112 is coupled to both first plate 242 and second plate 244 and is inserted within openings 250 and 252. Alternatively, first plate 242 may not include an opening and fastener 112 may be directly welded to first plate 242. In the exemplary embodiment, fastener 112 includes a first end portion 260 that is coupled to lifting eye 114, and a second end portion 262 that is coupled within first plate opening 250. More specifically, fastener 112 includes an opening 261 that extends from first end portion 260 to second end portion 262, and that enables lifting eye 114 to be coupled within opening 261. Second plate 244 also includes a plurality of second openings 264. More specifically, in the exemplary embodiment, second plate 244 includes four corner portions 266, and one second opening 264 is defined within each corner portion 266.

Form assembly 104 also includes a plurality of reinforcement bars (i.e., rebar members) 270 that are each coupled to outer frame 200 such that at least a portion of one rebar is positioned within one first flange opening 226 and one second flange opening 228. More specifically, in the exemplary embodiment, each rebar member 270 has a first end portion 272 and a second end portion 274, and first end portion 272 of one rebar member 270 is positioned within one first flange opening 226 and within one second flange opening 228 that is concentrically aligned with the one first flange opening 226. The second end portion 274 of the same rebar member 270 is positioned within a different first flange opening 226 and within one second flange opening 228 that is concentrically aligned with the different first flange opening 226. Moreover, in the exemplary embodiment, each opening 228 and 226 has one rebar member first end portion 272 or one rebar member second end portion 274 positioned therein such that rebar members 270 form a grid within outer frame 200 wherein each rebar member 270 is substantially parallel to at least one other rebar member 270 and each rebar member 270 is substantially perpendicular to at least one other rebar member 270. Alternatively, rebar members 270 may be coupled to outer frame 200 in any other suitable orientation that enables form assembly 104 and/or concrete slab 100 to function as described herein.

Moreover, in the exemplary embodiment, each rebar member 270 is positioned a predefined distance 273 above the ground 101. Form assembly 104 may also include at least one support member 271 coupled to at least one rebar member 270. More specifically, in the exemplary embodiment, support member 271 may be positioned directly under rebar member 270 between rebar member 270 and ground 101 such that support member 271 may facilitate maintaining rebar 270 the distance 273 above the ground 101.

At least four rebar segments 280 are positioned on at least a portion of some of the rebar members 270, and each of the four rebar segments 280 are coupled to outer frame 200 and lifting apparatus 110. As used herein, each rebar segment 280 is a rebar member that has a length that is substantially less than rebar members 270. In the exemplary embodiment, each rebar segment 280 includes a first end portion 282 and a second end portion 284, wherein first end portion 282 of one rebar segment 280 is positioned within one second opening 264 of second plate 244. Rebar segment 280 extends radially from lifting apparatus 110 and its second end portion 284 is positioned within one first flange opening 226 and one second flange opening 228 defined within one of the coupling portions 211, 212, 214, and 216. Accordingly, rebar segments 280 are coupled to outer frame 200 and to lifting apparatus 110 to define an X-shape within form assembly 104 to facilitate maintaining outer frame 200 in its predefined shape. More specifically, in the exemplary embodiment, because rebar segments 280 are coupled to outer frame 200 at the coupling portions 211, 212, 214, and 216, rebar segments 280 may: (a) couple first segment 202 to second segment 204 at first coupling portion 211, (b) couple second segment 204 to third segment 206 at second coupling portion 212, (c) couple third segment 206 to fourth segment 208 at third coupling portion 214, and (d) couple fourth segment 208 to first segment 202 at fourth coupling portion 216. As such, in the exemplary embodiment, rebar segments 280 maintain the substantially square shape of outer frame 200.

When form assembly 104 is assembled and coupled to ground 101 via posts 232, composite construction material 103 may be poured into center area 240 of form assembly 104 to prevent form assembly 104 from shifting or moving relative to ground 101. Composite construction material 103 is then poured within form assembly 104 such that material 103 is substantially evenly distributed within form assembly 104 and all rebar members 270 and rebar segments 280 are substantially covered by material 103. More specifically, material 103 may be poured within outer frame 200 from ground 101 to the top of fastener 112. As such, at least a portion of fastener first end portion 260 and lifting eye 114 are not covered by material 103. Material 103 may then be leveled and cured.

As compared to known form assemblies, the embodiments described herein provide a form assembly that can be readily assembled to facilitate the fabrication of portable concrete slabs. The form assembly includes an outer frame having a predefined shape, wherein the outer frame includes four segments that are coupled to together at four different coupling portions. A lifting apparatus is positioned in a location that is bounded by the outer frame and a plurality of rebar members are coupled to the outer frame. At least four rebar segments are positioned on the rebar members. Moreover, the rebar segments are coupled to the lifting apparatus and to the outer frame such that the four rebar segments define an X-shape within the form assembly to facilitate maintaining the outer frame in the predefined shape. By using an outer frame with a predefined shape, no measuring equipment is necessary to measure the segments that make up the outer frame and no cutting is required. Moreover, the rebar members are securely coupled to the outer frame and will not move as concrete composite construction material is poured within the form assembly. Further, having the four rebar segments define a substantially X-shape within the form assembly to facilitate maintaining the outer frame in the predefined shape ensures the desired shape of the concrete slab. In addition, the lifting apparatus enables the concrete slab to be easily transported to any desired location. Such easy assembly enables a user to assemble multiple form assemblies to fabricate multiple concrete slabs that have a consistency in their finished product. Accordingly, the form assembly provides an efficient and/or cost effective solution for use in fabricating portable concrete slabs.

Exemplary embodiments of the apparatus, systems, and methods are described above in detail. The apparatus, systems, and methods are not limited to the specific embodiments described herein, but rather, components of the apparatus and/or systems and/or steps of the methods may be utilized independently and separately from other components and/or steps described herein. For example, the systems may also be used in combination with other systems and methods, and is not limited to practice with only the systems as described herein. Rather, the exemplary embodiment can be implemented and utilized in connection with many other applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A form assembly comprising:

an outer frame having a predefined shape, said outer frame comprises at least two segments that are coupled together at a coupling portion that is defined by a portion of each of said at least two segments abutting one another, each of said at least two segments comprises an interior planar surface that is vertically oriented, and a first flange and a second flange that each extend substantially outwardly from said interior planar surface such that each of said first flange and said second flange are substantially perpendicular to said interior planar surface, wherein said second flange is positioned a predefined distance from said first flange, said first flange comprises a plurality of first flange openings extending substantially therethrough and said second flange comprises a plurality of second flange openings extending substantially therethrough, wherein said plurality of second flange openings are substantially concentrically aligned with said plurality of first flange openings, said interior planar surface is configured to enable said outer frame to define a shape of an outer surface of a hardened concrete composite construction material that is substantially evenly distributed within said form assembly;

a lifting apparatus positioned in a location that is bounded by said outer frame;

a plurality of rebar members coupled to said outer frame such that at least a portion of one of said rebar members extends at least partially through one of said plurality of first flange openings and one of said plurality of second flange openings; and at least four rebar segments coupled between said lifting apparatus and to said outer frame such that said at least four rebar segments define an X-shape within said form assembly to facilitate maintaining said outer frame in the predefined shape.

2. A form assembly in accordance with claim 1, further comprising at least one post member coupled to said outer frame.

3. A form assembly in accordance with claim 1, further comprising at least one support member coupled to at least one of said rebar members.

4. A form assembly in accordance with claim 1, wherein each of said at least two segments are fabricated from at least one of a metal, a plastic material, and a composite material.

5. A form assembly in accordance with claim 1, wherein one of said plurality of first flange openings and one of said plurality of second flange openings are defined within said coupling portion.

6. A form assembly in accordance with claim 1, wherein each of said plurality of rebar members are positioned a predefined distance above a ground.

7. A form assembly in accordance with claim 1, wherein said at least two segments comprise a first segment coupled to a second segment at a first coupling portion that is defined by a portion of each of said first and second segments abutting one another, a third segment coupled to said second segment at a second coupling portion that is defined by a portion of each of said second and third segments abutting one another, and a fourth segment coupled to said third segment at a third coupling portion that is defined by a portion of each of said third and fourth segments abutting one another and said fourth segment is also coupled to said first segment at a fourth coupling portion that is defined by a portion of each of said first and fourth coupling portions abutting one another.

8. A concrete slab comprising:

a form assembly comprising:

an outer frame having a predefined shape, said outer frame comprises at least two segments that are coupled together at a coupling portion that is defined by a portion of each of said at least two segments abutting one another, each of said at least two segments comprises an interior planar surface that is vertically oriented, and a first flange and a second flange that each extend substantially outwardly from said interior planar surface such that each of said first flange and said second flange are substantially perpendicular to said interior planar surface, wherein said second flange is positioned a predefined distance from said first flange, said first flange comprises a plurality of first flange openings extending substantially therethrough and said second flange comprises a plurality of second flange openings extending substantially therethrough, wherein said plurality of second flange openings are substantially concentrically aligned with said plurality of first flange openings;

a lifting apparatus positioned in a location that is bounded by said outer frame;

a plurality of rebar members coupled to said outer frame such that at least a portion of one of said rebar members extends at least partially through one of said plurality of first flange openings and one of said plurality of second flange openings; and at least four rebar segments coupled between said lifting apparatus and to said outer frame such that said at least four rebar segments define an X-shape within said form assembly to facilitate maintaining said outer frame in the predefined shape; and a concrete composite construction material substantially evenly distributed within said form assembly, said interior planar surface is configured to enable said outer frame to define a shape of an outer surface of said concrete composite construction material when said concrete construction material is hardened.

9. A concrete slab in accordance with claim 8, wherein said form assembly further comprises at least one post member coupled to said outer frame.

10. A concrete slab in accordance with claim 8, wherein said form assembly further comprises at least one support member coupled to at least one of said rebar members.

11. A concrete slab in accordance with claim 8, wherein each of said at least two segments are fabricated from at least one of a metal, a plastic material, and a composite.

12. A concrete slab in accordance with claim 8, wherein one of said plurality of first flange openings and one of said plurality of second flange openings are defined within said coupling portion.

13. A concrete slab in accordance with claim 8, wherein each of said plurality of rebar members are positioned a predefined distance above a ground.

14. A concrete slab in accordance with claim 8, wherein said at least two segments comprise a first segment coupled to a second segment at a first coupling portion that is defined by a portion of each of said first and second segments abutting one another, a third segment coupled to said second segment at a second coupling portion that is defined by a portion of each of said second and third segments abutting one another, and a fourth segment coupled to said third segment at a third coupling portion that is defined by a portion of each of said third and fourth segments abutting one another and said fourth segment is also coupled to said first segment at a fourth coupling portion that is defined by a portion of each of said first and fourth segments abutting one another.

15. A concrete slab in accordance with claim 8, wherein said first flange and said second flange are each formed with said interior planar surface such that said corresponding segment of said at least two segments is a monolithic piece such that each of said first flange and said second flange extend the entire length of said corresponding segment of said at least two segments.

16. A method of assembling a form assembly, said method comprising:

forming an outer frame in a predefined shape by coupling at least two segments at a coupling portion that is defined by a portion of each of the at least two segments abutting one another, wherein each of the at least two segments include an interior planar surface that is vertically oriented, and a first flange and a second flange that each extend substantially outwardly from the interior planar surface such that each of the first flange and the second flange are substantially perpendicular to the interior planar surface, wherein the second flange is positioned a predefined distance from the first flange, the first flange includes a plurality of first flange openings extending substantially therethrough and the second flange includes a plurality of second flange openings extending substantially therethrough, wherein the plurality of second flange openings are substantially concentrically aligned with the plurality of first flange openings, the interior planar surface is configured to enable the outer frame to define a shape of an outer surface of a hardened concrete composite construction material that is substantially evenly distributed within the form assembly;

positioning a lifting apparatus in a location that is bounded by the outer frame;

coupling a plurality of rebar members to the outer frame such that at least a portion of one of the rebar members is positioned within one of the plurality of first flange openings and one of the plurality of second flange openings; and coupling at least four rebar segments to the lifting apparatus such that the at least four rebar segments define a substantially X-shape within the form assembly to facilitate maintaining the outer frame in the predefined shape.

17. A method in accordance with claim 16, further comprising coupling at least one post member to the outer frame.

18. A method in accordance with claim 16, further comprising coupling at least one support member to at least one of the rebar members.

19. A method in accordance with claim 16, wherein forming an outer frame further comprises forming an outer frame in a predefined shape by coupling at least two segments that are fabricated from at least one of a metal, a plastic material, and a composite.

20. A method in accordance with claim 16, wherein coupling a plurality of rebar members to the outer frame further comprises coupling a plurality of rebar members to the outer frame such that each of the plurality of rebar members are positioned a predefined distance above a ground.

21. A method in accordance with claim 20, further comprising coupling at least one support member to at least one of the plurality of rebar members such that the at least one support member is positioned under at least one of the plurality of rebar members.

* * * * *